219-121 SR
11/25/80 XR 4,236,062

United States Patent [19] [11] 4,236,062
Lilly, Jr. et al. [45] Nov. 25, 1980

[54] APPARATUS FOR ELECTRICAL PERFORATION OF WEBS

[75] Inventors: A. Clifton Lilly, Jr., Richmond; Warren E. Claflin, Bon Air; William R. Hardesty, Richmond; George R. Scott, Mechanicsville; Roger L. Hopkins; Harry V. Lanzillotti, both of Richmond, all of Va.

[73] Assignee: Philip Morris Incorporated, New York, N.Y.

[21] Appl. No.: 920,992

[22] Filed: Jun. 30, 1978

Related U.S. Application Data

[63] Continuation-in-part of Ser. No. 789,367, Apr. 21, 1977, abandoned.

[51] Int. Cl.[3] ..... H05B 7/18
[52] U.S. Cl. ..... 219/384; 131/15 B; 162/286; 219/121 EB; 219/383
[58] Field of Search ..... 219/121 EB, 123, 383, 219/384; 346/74.1; 83/16, 170; 162/139, 192, 286; 93/1 R, 1 C; 131/15 B; 204/225

[56] References Cited

U.S. PATENT DOCUMENTS

| | | | |
|---|---|---|---|
| 2,372,508 | 3/1945 | Meaker | 219/384 X |
| 2,763,759 | 9/1956 | Mito et al. | 219/384 |
| 2,982,186 | 5/1961 | McKeen | 219/384 |
| 3,098,143 | 7/1963 | Warmt | 219/384 |
| 3,351,740 | 11/1967 | Heuer | 219/384 |
| 3,412,636 | 11/1968 | Sciff | 83/170 |
| 3,862,396 | 1/1975 | Machida et al. | 219/384 |
| 3,891,828 | 6/1975 | De Corso | 219/383 |

FOREIGN PATENT DOCUMENTS

| | | | |
|---|---|---|---|
| 2310047 | 1/1974 | Fed. Rep. of Germany | 219/384 |

*Primary Examiner*—Volodymyr Y. Mayewsky
*Attorney, Agent, or Firm*—Watson, Leavenworth, Kelton & Taggart

[57] ABSTRACT

A web is electrically perforated at high hole density by applying alternating-current voltage across an electrode pair facing the web while pressurized gas is supplied to the electrode gap. Voltage amplitude level and gas flow and direction thereof are selected to provide for the striking of multiple arcs per half-cycle, thereby enabling reduction in spacing between adjacent perforations in the web. Perforation practice involving preselection of cigarette filter tipping paper based on chemical composition of the paper is also disclosed as is apparatus for use in implementing the described practices, wherein electrode support members have gas flow conduits formed integrally therewith and wherein webs are taken up by a capstan drive unit resiliently biased into engagement with a web take-up roll.

8 Claims, 6 Drawing Figures

APPARATUS FOR ELECTRICAL PERFORATION OF WEBS

CROSS-REFERENCE TO RELATED APPLICATIONS

This application is a continuation-in-part of U.S. Application Ser. No. 789,367, filed on Apr. 21, 1977 now abandoned. The latter application was filed on even date with commonly assigned application Ser. No. 789,687 entitled, "Electrically Perforated Web and Method and Apparatus For Making Same," which was abandoned in favor of continuation application Ser. No. 952,614 filed Oct. 18, 1978.

FIELD OF THE INVENTION

This invention relates generally to the electrical perforation of web material and more particularly to apparatus for perforating cigarette filter tipping paper.

BACKGROUND OF THE INVENTION

In the manufacture of tobacco products, efforts at dilution, i.e., controlled introduction of air in the course of smoking, have looked to perforating the tabacco wrapper and to perforating the filter or plug tipping paper. Since the filter tipping paper is of substantially less area than the tabacco wrapper and portions of such area are not usefully perforatable by reason of being engaged by the smoker or adhesive-coated, the perforated area per unit length of useful area need be increased to attain desired dilution levels. Offsetting considerations apply here, however, since, as hole area per perforation is increased, subdued hole visibility lessens and smoke issuance through the tipping paper during non-puffing periods increases. An adequate compromise is to increase the density of holes of individual size sufficiently small to render the tipping paper apparently unperforated and substantially non-smoke issuing.

For relatively high dilution levels of interest, and considering tipping paper area usable for perforating, applicants concluded that holes in size ranging from ten to one hundred microns in diameter and spaced mutually by less than one millimeter are required. On examining filter tipping papers perforated by commercial suppliers at sufficient porosity (i.e., in perforated area), applicants found the products either insufficient in hole density or not available in production volume. While applicants have no knowledge as to the details of methods by which such examined filter tipping papers were made, it was evident from hole characteristics and density that the papers were electrically perforated. In respect of one sample paper found to have sufficient hole density, subsequently received production samples thereof evidenced substantially less hole density, leading to the conclusion that the sample paper was laboratory-tailored and not reproducible in production volume.

Concerning electrical perforation of webs, a vast number of prior efforts are known, as set forth in the prior art statement under 37 C.F.R. 1.97 and 1.98, to be filed herein.

SUMMARY OF THE INVENTION

It is an object of the present invention to provide apparatus for high density electrical perforating of webs.

A more particular object of the invention is to provide perforated cigarette filter tipping paper for use in diluted cigarettes.

In attaining the above and other objects, applicants have developed an electrical perforating system wherein a web is displaced relative to electrodes defining a spark gap therebetween with pressurized gas and voltage applied to the electrodes to provide web perforations per pair of opposed electrodes in excess of the customary single perforation per half-cycle or like amplitude excursion of the voltage source. By such practice, applicants provide filter tipping paper evidencing holes of size ranging from ten to one hundred microns in diameter and in density exceeding one thousand per square inch. In porosity, such paper is from ten to twenty-five hundred Coresta permeability units, enabling its use in cigarettes having dilution levels of five to seventy percent.

The foregoing and other objects and features of the invention will be further evident from the following detailed description of practices and apparatus and from the drawings wherein like reference numerals identify like parts throughout.

DESCRIPTION OF THE PREFERRED EMBODIMENT

Figure 1:
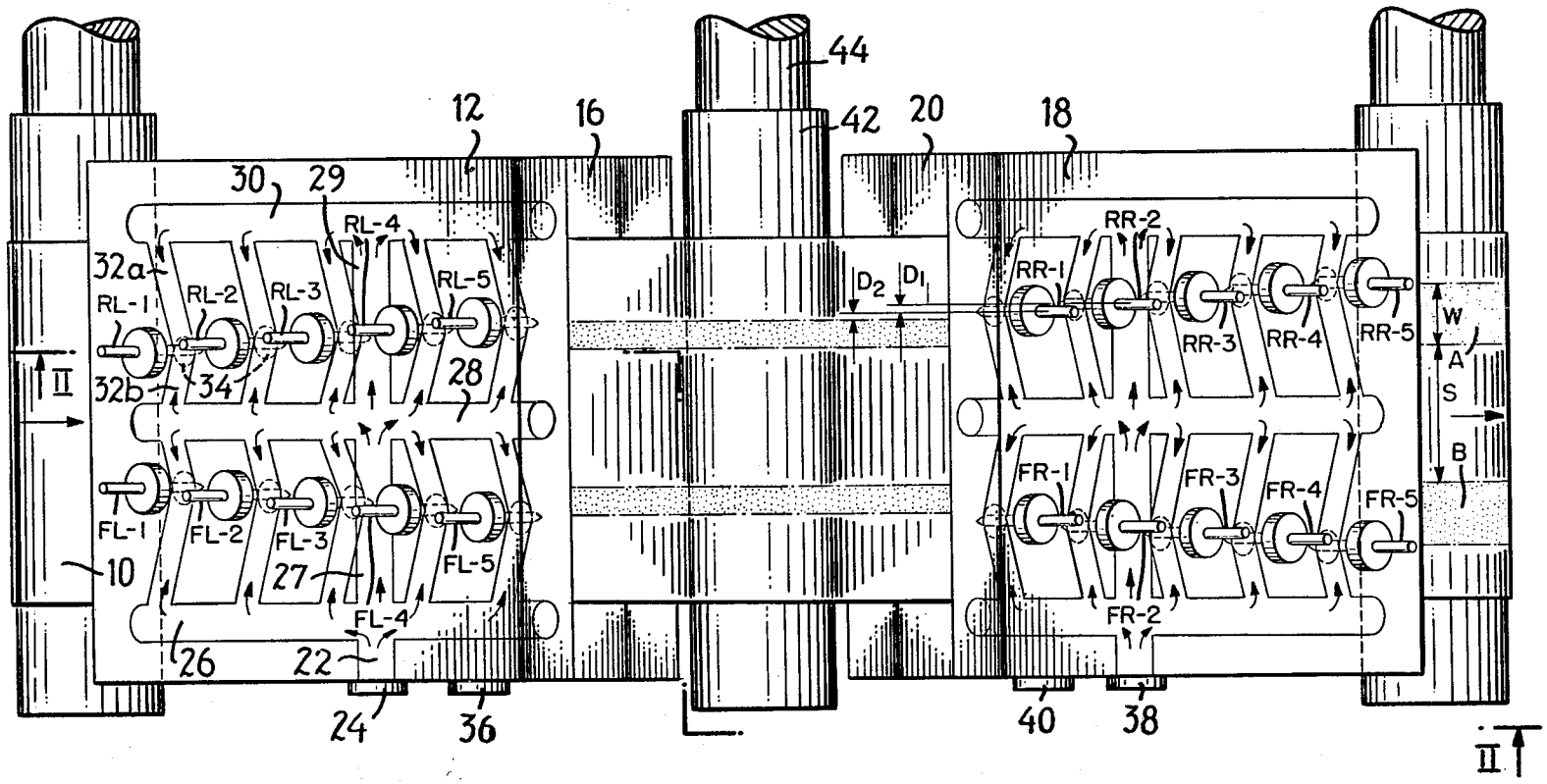
FIG. 1 is a plan view of web perforating apparatus.
Figure 2:
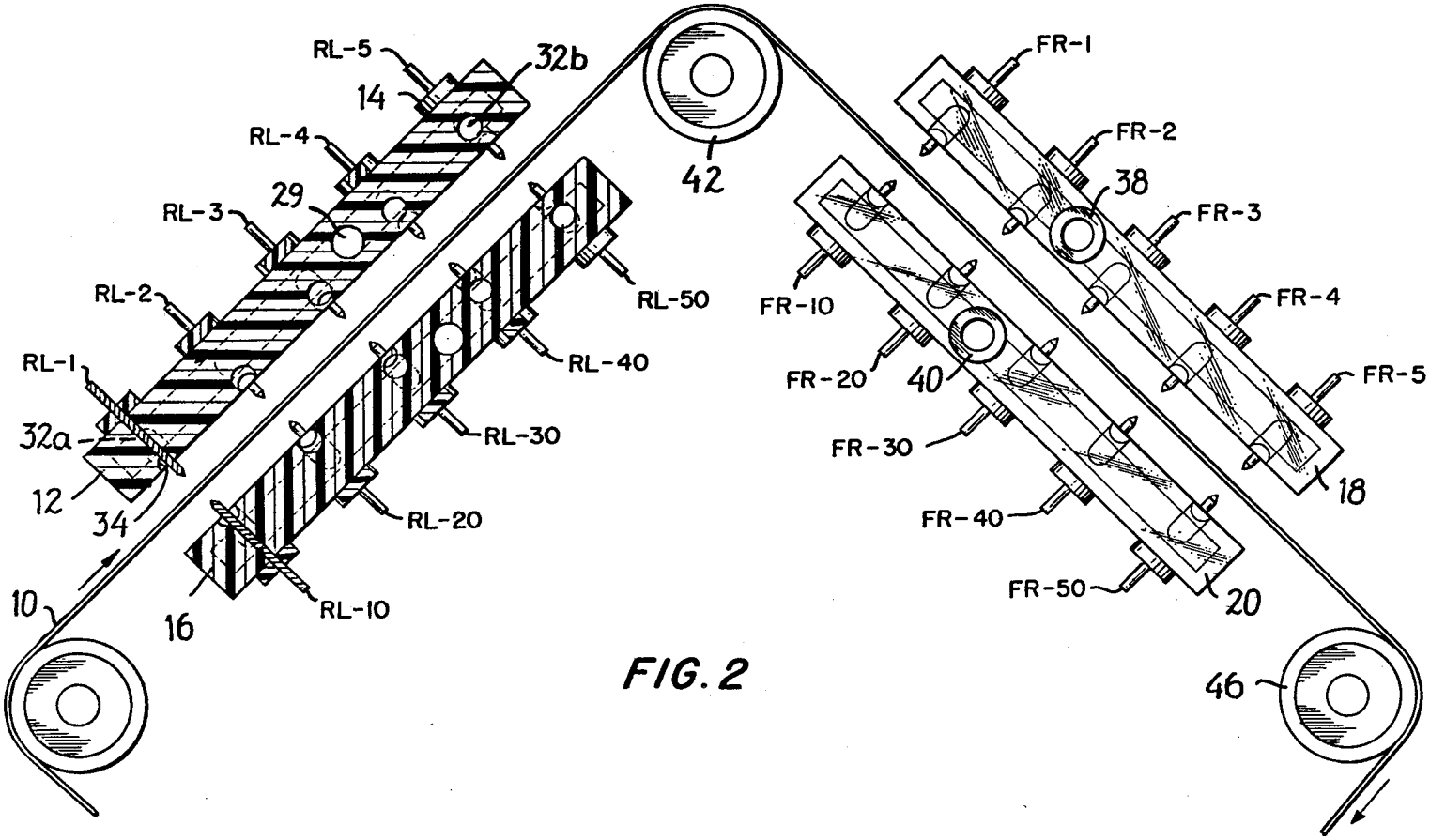
FIG. 2 is a front elevation partly in section taken along line II—II of FIG. 1.

Referring to FIGS. 1 and 2, web 10 may be a continuous sheet of cigarette filter tipping paper and is advanced rightwardly in the drawings from a web supply roll (not shown). Considering the far righthand portion of FIG. 1, two cross-hatched areas A and B are shown on web 10. Such areas are approximately five millimeters in width W, are spaced apart by spacing S of approximately twenty-four millimeters and are designated as the portions of web 10 which are perforated at high hole density.

As is the custom in cigarette making, opposed tobacco rod sections and an intervening double filter link are brought to end-to-end abutting relation and filter tipping paper applied thereto for joining the two tobacco rod sections and the intervening double filter link. Subsequently a cut is made symmetrically, such as between cross-hatched areas A and B in FIG. 1, severing the assembled unit into two independent cigarettes. While such cigarette making practice forms no part of the subject invention, it serves to indicate that, in the ultimately manufactured cigarette, the areas of perforations in filter tipping paper made in accordance with the subject invention occupy a position substantially distant from the end of the filter engaged by the smoker.

In electrically perforating cross-hatched areas A and B of elongate web 10, four groups of electrodes are employed, designated RL (rear left), RR (rear right), FL (front left) and FR (front right). The right and left pairs of electrode groups are identical in components but are displaced mutually laterally so that each group perforates one-half of each of the cross-hatched areas A and B. This shortens the unsupported path length involved in the travel of elongate web 10 through the perforating system. Each electrode group includes five electrodes, identified by the reference numerals −1 through −5, used jointly with the electrode group designation. The electrodes in each group are spaced uniformly longitudinally of web 10 and are further disposed in unique locations laterally of the web. Considering electrode group RR, electrodes RR-1 and RR-2 are spaced laterally of web 10 by distance D1, an amount approximately one-tenth of the intended width of the cross-hatched area A. Like lateral spacing exists between the remainder of the electrodes of group RR and the same applies to the electrodes of group FR with respect to area A and to the electrodes of groups FL and RL with respect to area B. Laterally adjacent electrodes in groups RR and RL, i.e., RR-1 and RL-5, are spaced laterally by distance D2 also equal to approximately one-tenth of the width of cross-hatched area A and t the same applies for electrodes FL-1 and FR-5 with respect to area B. Accordingly, each electrode of the series of the twenty electrodes confronting web 10 in the course of its conveyance through the apparatus of FIGS. 1 and 2 is in facing relation to a unique lateral subzone of areas A and B. Under certain conditions, it is envisioned that both right and left groups would not be needed and therefore a single electrode group would be used to perforate a full band width.

Electrodes RL-1 through RL-5 and FL-1 through FL-5 are supported in electrically insulative plate 12, being removably secured to the upper surface of the plate by fittings 14. The electrodes extend both upwardly of fittings 14, to be engaged by electrical conductors (not shown) and downwardly of plate 12 to terminate in needle-shaped ends adjacent the upper surface of web 10. A further electrically insulative plate 16 is disposed adjacent the undersurface of web 10 and supports electrodes in gapdefining alignment with the electrodes supported by plate 12. In the sectionally shown leftward portion of FIG. 2, such lower electrodes, RL-10 through RL-50, are in alignment respectively with electrodes RL-1 through RL-5. Electrodes RR-1 through RR-5 and FR-1 through FR-5 are supported in plate member 18 adjacent the upper surface of web 10 and a further plate member 20 supports an electrode in gap-defining alignment with each of these electrodes. As shown in FIG. 2, plate 20 has frontal electrodes FR-10 through FR-50, respectively in alignment with electrodes FR-1 through FR-5.

Each of the plate members 12, 16, 18 and 20 includes an identical air conduit network for issuing pressurized air or other gas onto web 10 and the electrode ends adjacent web 10. Considering plate member 12 in this respect, an inlet conduit 22 extends from fitting 24 to service longitudinal conduit 26 and transverse conduit 27 which in turn services longitudinal conduit 28. Conduit 28 communicates with transverse conduit 29 which in turn services longitudinal conduit 30. Branch conduits for issuing onto electrodes are associated with each of longitudinal conduits 26 and 30. For example, branch conduit **32*a* extends from longitudinal conduit 30 downwardly to an issue port 34 (FIG. 2) for issuing pressurized air applied to fitting 24 onto the surface of electrode RL-1. Branch conduit 32*b* extends to an issue port (not shown) opposite port 34, whereby further pressurized air issues onto electrode RL-1. Fittings 36, 38 and 40 are provided for plate members 16, 18 and 20, respectively. Completing the description of parts shown in FIGS. 1 and 2, roller 42 is rotatively supported on shaft 44 contiguous with web 10 to support the web in its course between its courses respectively between plate members 12 and 16 and plate members 18 and 20. Exit roller 46 (FIG. 2) supports web 10 as it exits the space between plate members 18 and 20. A housing (not shown) is pivotally supported for movement into substantially enclosing relation with the apparatus of FIGS. 1 and 2** and is connected to a vacuum source for withdrawal and disposal of ozone and other gases generated during operation of the apparatus. The housing has side openings for entry and exit of the web.

Figure 3:
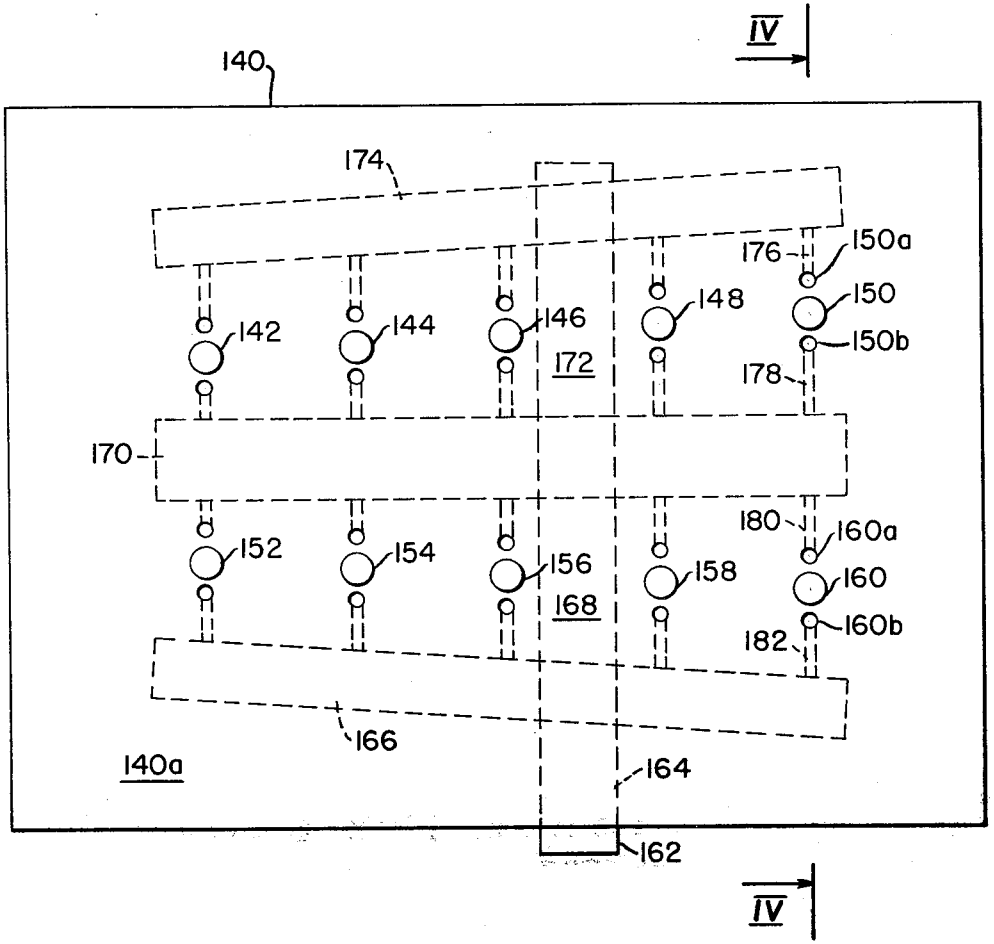
FIG. 3 is a plan view of a preferred embodiment of pressurized gas-issuing and electrode-supporting plate assembly in accordance with the invention.

Plate member 140, a particularly preferred embodiment of the invention, has its undersurface **140*a* shown in FIG. 3. The plate member supports electrodes 142 through 160 in the positional arrangement identical with that above discussed for plate members 16 and 18. An air conduit network for issuing pressurized gas onto the web to be perforated is provided within plate member 140 and includes inlet fitting 162, inlet conduit 164 extending from fitting 162 to service longitudinal conduit 166 and transverse conduit 168. Conduit 168 communicates with longitudinal conduit 170 and in turn services transverse conduit 172. Conduit 172 communicates with longitudinal conduit 174**.

Figure 4:
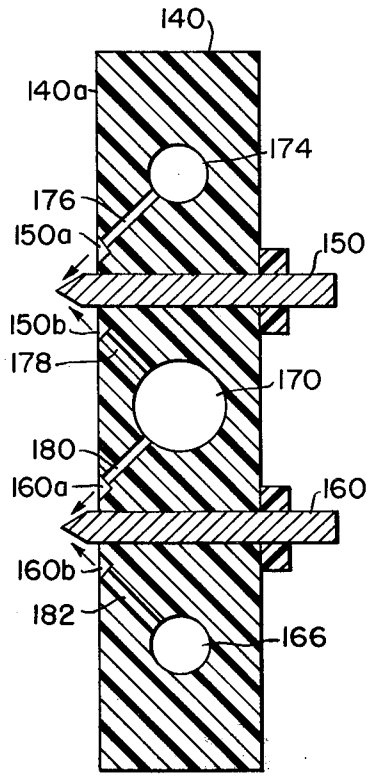
FIG. 4 is a sectional view of the FIG. 3 plate assembly as seen from plane IV—IV of FIG. 3.

As is shown in FIG. 4 for electrodes 150 and 160, each electrode is supplied with pressurized gas from diametrically opposed ports situated aside such electrode. Thus, ports **150*a* and 150*b* are adjacent electrode 150 and define seats in undersurface 140*a* for nozzles (not shown). Gas is conducted to port 150*a* from conduit 174 through branch conduit 176 and is conducted to port 150*b* from conduit 170 through branch conduit 178. Ports 160*a* and 160*b* are adjacent electrode 160 and also define nozzle seats in undersurface 140*a*. Gas is conducted to port 160*a* from conduit 170 through branch conduit 180 and is conducted to port 160*b* from branch conduit 166 through branch conduit 182. The branch conduits are acutely inclined with respect to the plane of the web to be perforated, which is conveyed parallel to undersurface 140*a*. The branch conduits preferably have lines of intersection at the tip point of the needle electrodes, as indicated by arrows shown adjacent the ports in FIG. 4**. The arrangement described provides for the issuance of laterally oppositely directed pressurized gas streams into the electrode gap, thus providing lessened net lateral thrust on arcs struck from electrodes and serving to efficiently dispel ionized gas from electrode gaps.

Figure 5:
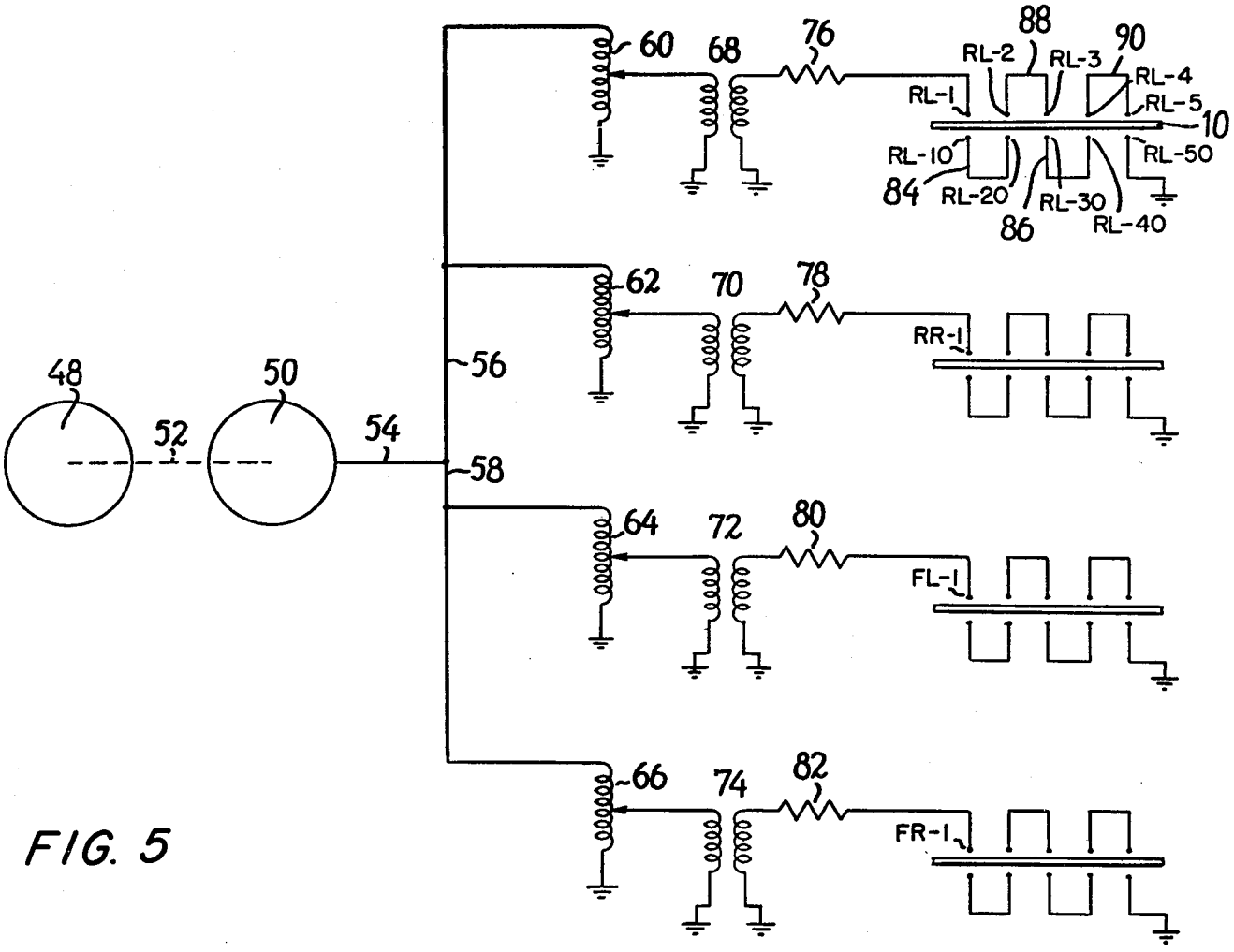
FIG. 5 is an electrical schematic diagram of the circuit components for the preferred embodiment of the invention.

Referring to FIG. 5, the electrode-energizing system of the invention is preferably alternating-current (a-c) based and includes motor 48 driving generator 50 through mechanical linkage 52. The generator output is applied over lines 54, 56 and 58 and parallel autotransformers 60, 62, 64 and 66 which may be conventional variacs, furnishing variably selectable amplitude voltage respectively to the primary windings of transformers 68, 70, 72 and 74. Secondary windings of the transformers are connected through resistors 76, 78, 80 and 82 to the electrodes of FIGS. 1 and 2. Each transformer is arranged to service a distinct electrode group. Accordingly, resistor 76 is connected to electrode RL-1, resistor 78 to electrode RR-1, resistor 80 to electrode FL-1 and resistor 82 to electrode FR-1. The electrodes in each group are connected correspondingly as indicated for electrode group RL in FIG. 3. For this group, electrodes RL-10 and RL-20 are interconnected by conductor 84, electrodes RL-30 and RL-40 are interconnected by conductor 86, electrodes RL-2 and RL-3 are interconnected by conductor 88 and electrodes RL-4 and RL-5 are interconnected by conductor 90. Electrode RL-50 is connected to ground. In the illustrated circuit arrangement, the gaps between aligned electrodes of each group are series-connected across each transformer secondary. The windings of all autotransformers and transformers are grounded as indicated.

Figure 6:
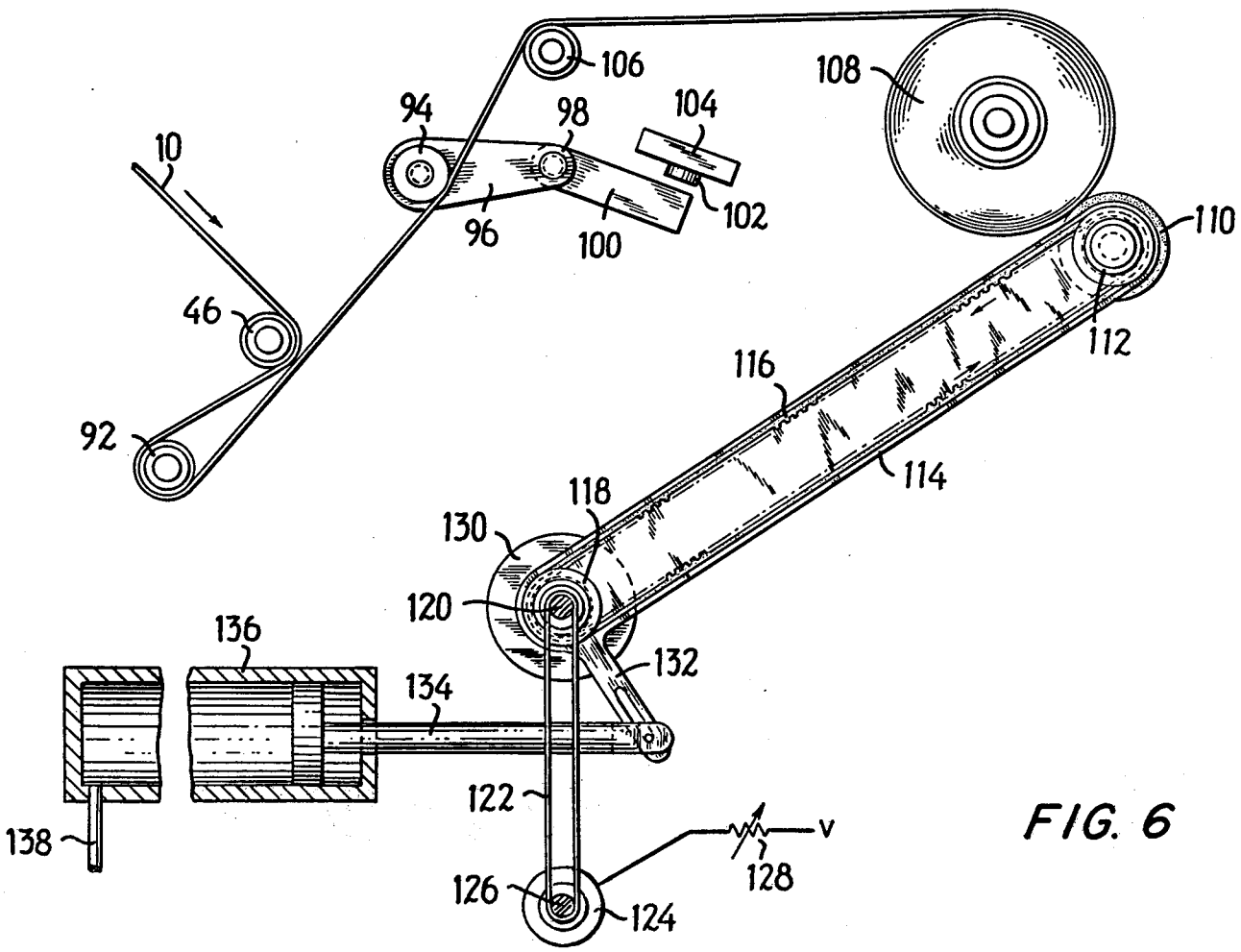
FIG. 6 is a mechanical schematic drawing of web rewind apparatus.

Turning now to FIG. 6 to complete the description of apparatus employed in practicing the invention, web 10 is conveyed from roller 46 (discussed above in connection with FIG. 2) downwardly around roller 92 and upwardly therefrom. In its upward travel from roller 92, web 10 is loaded slightly by roller 94. This roller is rotatively supported in lever 96 which is itself rotatively supported about pin 98. Weighted arm 100 is rigidly arranged with lever 96 to rotate therewith. On breakage of web 10, or predetermined lessening of longitudinal web tension, lever 96 rotates counterclockwise by gravity displacing arm 100 into engagement with operator 102 of switch 104, thereby opening the switch and interrupting web transport and supply of voltage to the electrode groups. Beyond roller 94, web 10 traverses roller 106 and is fed to take-up or rewind roll 108.

The drive arrangement for web take-up includes a driven roller 110 keyed to shaft 112 which is rotatively supported at the rightward end of take-up control arm 114. Shaft 112 preferably has a gear belt pulley keyed to its periphery for engaging gear belt 116 whereby roller 110 is driven counterclockwise upon advance of chain 116 in the direction indicated by the arrows in FIG. 4. At its leftward end, control arm 114 supports gear belt pulley 118 for rotation relative thereto, gear belt pulley 118 being keyed to transfer shaft 120. Shaft 120 includes a gear belt pulley keyed peripherally thereto engaged by a second gear belt 122. Gear belt 122 is driven in the direction indicated by the arrows by tachometer-driven motor 124, the motor output shaft 126 being keyed to a peripheral gear belt pulley engaging gear belt 122. The field winding of motor 124 is connected to excitation source V through variable resistor 128 whereby the speed of conveyance of web 10 may be preselected. Once selected, such web speed is maintained constant by the tachometer control in motor 124.

Housing 130 supports control arm 114 for rotation about the leftward control arm end. The angular position of arm 114 is controlled by positioning of level 132, integral with arm 114 and rotatably secured to the output actuator 134 of air cylinder 136. The cylinder is furnished with pressurized air through inlet 138 whereby arm 114 is rotated to place roller 110 in driving engagement with web 10 after the wrap is wound on roll 108. In operation, motor 124 awaits its energization, by suitable time delay circuitry, until sufficient air pressure is developed in cylinder 136 to insure that roller 110 is in driving engagement with web 10. In the course of web take-up, cylinder 136 serves to apply bias to control arm 114 to maintain driving engagement of roller 110 with roll 108.

By way of introduction to one aspect of practice hereunder, consider an a-c source operating to provide one thousand cycles per second (cps). The period per full cycle is 0.001 seconds or one millisecond. The half-period, i.e., the duration of each half-cycle, is 0.5 ms. With such voltage applied across opposed gap-defining electrodes, assume a web traversing the gap at a lineal speed of nine hundred feet per minute (fpm). The lineal extent of web passing by the electrodes in the half-cycle period may be calculated to be 2.29 mm. At such voltage source frequency and web speed, one obtains a minimum hole spacing of 2.29 mm per electrode. In prior art practices, identified in applicants' aforesaid statement under 37 C.F.R. 1.97 and 1.98, one preselects source frequency and web speed to achieve desired uniform hole spacing and adjusts source amplitude to attain desired hole size. Provision may be made for modifying one or more of these parameters to compensate for change in another of the parameters to maintain uniformity of hole spacing or constancy in porosity.

In practice discussed below, adjacent hole spacing of 0.79 mm is achieved hereby under the aforesaid conditions of web speed (900 fpm) and source frequency (1000 cps), an improvement in hole density of about 2.9 over that obtained by prior known methods. Such improvement of almost a factor of three provides for porosity levels in filter tipping paper sufficient for the high dilution level cigarettes of current interest.

In approaching the subject problem, conditions were sought under which arcs could be struck with higher time density than the single arc per half-cycle or other voltage excursion of the known prior art methods. In one aspect of the subject study, the practice of spark blasting was considered, i.e., applying pressurized gas through the spark gap to enhance arc-quenching by the removal of ionized media in the gap. Additively to this practice, voltage over-driving of electrodes was undertaken, i.e., applying voltage to electrodes in amplitude level substantially in excess of the amplitude level required to initiate an arc in a given gap length through a web of given dielectric constant. As results reported below indicate, proper coordination of these two parameters, gas flow and voltage amplitude level for a given gap length and dielectric breakdown strength produces the phenomenon of multiple arc-striking per half-cycle or equivalent voltage excursion. Conversely, reductions in level of either of such parameters from the coordination thereof producing such multiple arc-striking brings on an asymptotic approach to the customary single-arcing condition.

With a gas flow of 0.40 cubic feet per minute (cfm) per each electrode, a-c voltage (VAC) across the electrodes is varied in the table below with indicated results. Source frequency is set at 1000 cps and paper speed at 400 fpm. The electrodes have a conical arc tip with interior angle of 60° and the gap therebetween is 0.030 inch. The web is commercially-available Ecusta cork 52 mm tipping paper, 36 gram/m basis weight.

| VAC | Holes | R1 | R2 | R3 |
|---|---|---|---|---|
| 5000 | 38 | 1.0 | 1.0 | 1.0 |
| 6000 | 45 | 1.06 | 1.18 | 1.11 |
| 7000 | 49 | 1.12 | 1.29 | 1.15 |
| 7500 | 51 | 1.15 | 1.34 | 1.17 |
| 8500 | 58 | 1.19 | 1.53 | 1.29 |

For the source frequency and web speed conditions stated, the single-arc situation can be calculated to yield one hole per mm or 39 holes per 40 mm length. As indicated in the table, the single-arc situation applies at 5000 volts, which is an amplitude level about twice the gap breakdown level (approximately 2500 volts). R1 defines the ratio (on-time) of time, per half-cycle, during which the amplitude level of applied voltage VAC exceeds the gap breakdown level, to the corresponding time for 5000 volts VAC. R2 defines the ratio of observed holes to the number of holes obtaining for the single-arc-strike situation. R3 is the ratio of R2 to R1. For 6000 volts, the number of holes observed in a 40 mm web length increases to 45, an improvement of 1.18. As will be observed, increasing VAC levels give rise to increased hole densities, an increase exceeding one and one-half being reached at the VAC level of 8500 volts. The values for R2 and R3 are further illustrative of the phenomenon whereby the change in number of holes increases by a figure of merit in excess of the improvement which might be expected simply from increased on time. Thus, at 8500 volts VAC, on-time increases by 1.19 (R2) while hole density is improved by a factor of 1.53 (R1), the further improvement beyond on-time being indicated (R3=1.29).

A practical limit to maximum hold density has been observed which is dependent on the type of paper being perforated. Thus, for a given paper, it has been found that a point is reached where greater hole density cannot be achieved despite further increase of the control features of voltage amplitude and gas flow. While the arc frequency does increase, the arcs are expended through previously perforated holes rather than through the unperforated paper directly between an electrode pair. In this case, the dielectric breakdown strength of air through the path including a previous hole is less than the dielectric breakdown strenght of the straight path including the unperforated paper between the electrodes. This situation, i.e., nonperforating arcing, is maintained until the straight path becomes the path of least resistance.

An understanding of certain paper parameters has been achieved which helps to determine the optimum paper type for a given usage. The dielectric breakdown strenght is proportional to the basic weight of a particular type paper as more material (thickness) will increase the difference between the straight path plus paper and the longer path through air and a previously perforated hole. Preferred thickness for filter tipping paper is from 0.0005 inch to 0.01 inch.

The chemical composition of the paper has also been found to bear upon maximum attainable hole density as well as contribute to material build-up on the electrodes during operation. This build-up, depending upon its amount and composition, can change the electrical properties of the arc as well as actually physically tear or break the web being perforated. Preferred paper components, apart from the predominant structural fiber, e.g., cellulosic fiber, have been found to be non-acidic components, such as $CaCo_3$, $MgCo_3$ and $TiO_2$. Filter tipping paper rendered chemically non-acidic is accordingly preferably preselected in practice under the invention. Acidic products such as iron oxide and clay (Kaolinite) tend to bond more easily with the metal electrodes (i.e., tungsten or other suitable metal) and lead to harder build-up products which are not removed readily by the moving paper and tend to finally break the web. The basic or neutral paper components, as opposed to acidic, such as $CaCo_3$, $MgCO_3$ and $TiO_2$ do not bond as readily to such metal electrodes. Thus, deposits which may occur on the electrodes are more readily removed from the electrodes by the moving web and therefore web breakage is minimized.

In brief summary of the foregoing, in one aspect of practice herein, selection of voltage level and gas flow is made relative to the voltage excursion time and web speed such that perforation spacing is less than the lineal extent of web traversing an electrode gap duing such voltage excursion time. A longitudinally and laterally spaced grouping of n electrode pairs, n being five for each of the FIG. 1 electrode groups, is preferably employed. As shown for rearward and frontal electrodes, one rearward group is laterally successive to the other rearward group and one frontal group is laterally successive to the other frontal group.

In another aspect of practice herein, a practice for perforating filter tipping paper involves a preselection of paper based on chemical composition, a selection found to bear upon hole density.

In other aspects of the disclosure, apparatus desirably incorporates, in unitary structure, electrode support capability and pressurized gas conduits issuing onto supported electrodes, wherein plate members have conduits and issue ports therefor structurally integral therewith. In providing for enhanced residue of a web in desired position throughout extended conveyance thereof, one electrode pair or group may be arranged successive to another pair or group in the direction of linewise conveyance of the web with a web support contiguously engaging the web and located successive to the one pair and precedent to the other. Apparatus for use in perforation practice has a web take-up arrangement of resiliently-biased capstan-type wherein a pivotally movable control arm includes a drive linkage for a driven roller engaging the web as taken up and air-pressure bias maintains engagement of the take-up roll and driven roller during pivotal movement of the control arm occasioned by web take-up.

While a complete theoretical explanation of the phenomena reached by practice herein in its first-noted aspect is not presently known, the attainment of holes in excess of that obtaining in prior known practices is established as being attributable to multiple arc striking as shown by example and observed by oscilloscopic studies. An approach to the single-arcing situation has been observed to occur concomitantly with change in the control parameters of gas flow and voltage amplitude level.

As noted, a-c voltage is preferably employed in practicing the invention whereby two voltage amplitude excursions per cycle are defined by the positive and negative half-cycles, the former former commencing at 0° and ceasing at 180° and the latter commencing at 180° and ending at 360°. Either half-cycle may be inverted to provide unidirectional half-cycles. Practice hereunder likewise contemplates pulsed direct current voltage which also provides voltage amplitude excursions suitable for use in affecting multiple arc-striking.

In respect of issue ports, the results tabulated above were reached with 1/32 inch nozzles for each of the opposed pair of the nozzles for each opposed electrode being pressurized with air at 20 psi. Other nozzles employed were 1/64 and 1/16 inch, providing gas flow levels from 0.2 to 3.0 cfm per electrode.

In FIG. 5 preferred electrical circuit arrangement, the secondary windings of each of transformers 68–74 preferably apply 12,000 volts across the series-circuit of five electrode pairs. On arcing, the voltage across each electrode gas is in the order of 400 volts, providing an overvoltage of 10,000 volts. With gap breakdown voltage being 1,500 to 2,500 volts for typical filter tipping papers, the overvoltage multiple is seen to be from four to about seven during arcing. In an alternate circuit arrangement, a transformer is provided for each electrode pair, furnishing 6,000 volts across the electrode pair and hence an overvoltage multiple of from about two to four.

Various changes and modifications may be introduced in the foregoing practices and apparatus without departing from the invention. Thus, the particularly described practices and apparatus are intended in an illustrative and not in a limiting sense. The true spirit and scope of the invention is defined in the following claims.

What is claimed is:

1. Apparatus for perforating a planar web comprising:

(a) electrode means including first and second electrodes;

(b) first and second plate members supporting said first and second electrodes in spaced opposing relation to define a gap therebetween for passage of said web;

(c) means for issuing plural separate streams of pressurized gas onto the surface of each of said electrodes adjacent said gap, said gas issuing means comprising for each of said electrodes conduits, each of said conduits having a gas issue port adjacent its associated electrode and a conduit portion extending from said gas issue port at an acute angle with respect to the plane of said web passing within said gap;

(d) means for generating voltage having amplitude excursions with the passage of time and for applying such generated voltage to said electrode means, said applied voltage causing sparks between said electrodes across said gap; and (e) means for conveying said web linewise through said gap for perforation by said sparks.

2. The apparatus claimed in claim 1 wherein the conduits associated with said electrodes extend interiorily of said first and second plate members, respectively.

3. The apparatus claimed in claim 2 wherein the gas issue ports of the conduits associated with said electrodes are defined by and structurally intergral with said first and second plate members, respectively.

4. The apparatus claimed in claim 3 wherein said gas issue ports of the conduits associated with each electrode are arranged as a diametrically opposed pair adjacent that electrode.

5. The apparatus claimed in claim 3 wherein the conduit sections of the conduits associated with said first and second electrodes are defined by and structurally integral with said first and second plate members respectively and communicate with said issue ports.

6. The apparatus claimed in claim 1 wherein said electrode means includes third and fourth electrodes, said apparatus having third and fourth plate members supporting said third and fourth electrodes in spaced relation to define a gap therebetween for passage of said web and successive to said first and second electrodes in the direction of such linewise conveyance of said web and web support means located successive to said first and second electrodes and precedent to said third and fourth electrodes.

7. The apparatus claimed in claim 6 wherein such gas-issuing means further comprises conduits extending interiorly of said third and fourth plate members.

8. The apparatus claimed in claim 1 wherein such web conveying means includes a web take-up roll and drive means for said roll comprising a roller, motive means for driving said roller, control arm means for supporting said roller at a given location thereon for driving engagement of said roller with said take-up roll, means for pivotally supporting said control arm means about a further location thereof distal from said given location and means for biasing said control arm to maintaining said driving engagement of said roller with said take-up roll during pivotal movement of said control arm means in the course of the take-up of said web by said take-up roll.

* * * * *